US008147688B2

(12) United States Patent
Adams et al.

(10) Patent No.: US 8,147,688 B2
(45) Date of Patent: Apr. 3, 2012

(54) STORMWATER CHAMBER DETENTION SYSTEM

(75) Inventors: David R. Adams, Raymond, ME (US); Daniel W. Aberle, Portland, OR (US); Daniel P. Cobb, Gray, ME (US); Gregory W. Byrne, West Linn, OR (US)

(73) Assignee: Contech Engineered Solutions LLC, West Chester, OH (US)

( * ) Notice: Subject to any disclaimer, the term of this patent is extended or adjusted under 35 U.S.C. 154(b) by 163 days.

(21) Appl. No.: 12/556,728

(22) Filed: Sep. 10, 2009

(65) Prior Publication Data

US 2010/0059430 A1 Mar. 11, 2010

Related U.S. Application Data

(60) Provisional application No. 61/096,144, filed on Sep. 11, 2008.

(51) Int. Cl.
*E03F 1/00* (2006.01)

(52) U.S. Cl. ..... 210/170.03; 210/170.08; 210/254; 210/299; 210/532.1; 405/40; 405/46; 405/49; 405/51

(58) Field of Classification Search ..... 210/170.03, 210/170.08, 254, 299, 521, 532.1; 405/36, 405/38, 40, 43, 46, 49, 51
See application file for complete search history.

(56) References Cited

U.S. PATENT DOCUMENTS 3,770,623 A * 11/1973 Seidel ..... 210/170.08
4,759,661 A 7/1988 Nichols et al.
5,017,041 A 5/1991 Nichols
5,087,151 A 2/1992 DiTullio
5,156,488 A 10/1992 Nichols
5,336,017 A 8/1994 Nichols
5,401,116 A 3/1995 Nichols
5,401,459 A 3/1995 Nichols et al.
5,419,838 A 5/1995 DiTullio
5,511,903 A 4/1996 Nichols et al.
5,588,778 A 12/1996 Nichols et al.
5,716,163 A 2/1998 Nichols et al.
5,773,756 A 6/1998 DiTullio
5,839,844 A 11/1998 Nichols et al.
5,890,838 A 4/1999 Moore, Jr. et al.
6,129,482 A 10/2000 Ditullio
6,322,288 B1 11/2001 DiTullio
6,361,248 B1 3/2002 Maestro
D465,545 S 11/2002 Maestro
D469,187 S 1/2003 Maestro
6,602,023 B2 8/2003 Crescenzi et al.
6,612,777 B2 9/2003 Maestro
6,679,653 B1 1/2004 DiTullio
6,680,011 B2 1/2004 Moore, Jr. et al.
6,719,490 B2 4/2004 Maestro
6,854,925 B2 2/2005 DiTullio
6,991,734 B1 1/2006 Smith et al.
6,994,355 B2 2/2006 Brochu et al.
(Continued)

*Primary Examiner* — Christopher Upton
(74) *Attorney, Agent, or Firm* — Thompson Hine LLP

(57) ABSTRACT

A stormwater detention system includes a containment row for removing and collecting solids from stormwater. The containment row may be surrounded by a water-impermeable membrane, and designed to receive incoming water before other rows of the detention system. The containment row collects solids from the stormwater before the water is redirected into one or more additional rows, which are water permeable and buried in water permeable media. Filter structure may be associated with a flow system that delivers water from the containment row to the additional rows.

19 Claims, 13 Drawing Sheets

U.S. PATENT DOCUMENTS 6,994,490 B2 2/2006 Maestro
7,004,221 B2 2/2006 Moore, Jr. et al.
7,008,138 B2 3/2006 Burnes et al.
7,052,209 B1 5/2006 Kruger et al.
7,118,306 B2 10/2006 Kruger et al.
7,189,027 B2 3/2007 Brochu et al.
7,207,747 B1 4/2007 England
7,217,063 B2 5/2007 Moore, Jr. et al.
7,226,241 B2 6/2007 DiTullio
7,237,981 B1 7/2007 Vitarelli
7,273,330 B1 9/2007 Brochu et al.
7,300,226 B1 11/2007 Maestro
7,632,408 B1 * 12/2009 Everson ..... 210/170.08
7,727,388 B1 * 6/2010 Houck ..... 210/170.08
2003/0219310 A1 11/2003 Burnes et al.
2005/0074286 A1 4/2005 Swistak et al.
2005/0074288 A1 4/2005 Moore et al.
2005/0238434 A1 10/2005 Coppes et al.
2006/0076714 A1 4/2006 Swistak et al.
2006/0138706 A1 6/2006 Brochu et al.
2006/0233612 A1 10/2006 DiTullio
2007/0077122 A1 4/2007 Birchler et al.
2007/0154261 A1 7/2007 Brochu et al.
2007/0172314 A1 7/2007 Brochu et al.
2007/0231071 A1 10/2007 Brochu et al.
2007/0258770 A1 * 11/2007 Miskovich ..... 405/43

* cited by examiner

STORMWATER CHAMBER DETENTION SYSTEM

CROSS-REFERENCES

This application claims the benefit of U.S. Provisional Application No. 61/096,144, filed Sep. 11, 2008, the entirety of which is hereby incorporated by reference.

TECHNICAL FIELD

This application relates generally to a stormwater detention system, and more particularly to a chamber based detention system including a containment row for collecting solids from stormwater.

BACKGROUND

Molded plastic detention chambers for burial in the earth for use in temporary stormwater detention are known. Multiple connected chambers can be used as a stormwater detention system to handle significant water throughput. Cleaning debris from these many chambers can be time-consuming and costly. It would be desirable to provide a stormwater chamber detention system that concentrates a significant portion of the debris in fewer of the system's chambers.

SUMMARY

A stormwater detention system includes chambers arranged in rows within a water permeable medium such as gravel. The rows are connected by pipes. One or more rows, designated collection rows, are arranged such that a significant portion of water entering the system through the pipes is diverted to the collection rows first. The collection rows are water impermeable. Stormwater that enters a collection row leaves primarily by means of the pipes and then enters other chamber rows in the detention system. Chamber rows other than collection rows are water permeable such that water that enters these rows may exit through the surrounding water permeable media. Debris found in the stormwater, particularly in the first flush of stormwater during a storm event, settles in the collection row (or rows) before entering the other chamber rows, thus allowing maintenance efforts to focus on the collection rows rather than moving into all the rows within a detention arrangement.

In one aspect, stormwater detention system includes a containment row buried in water permeable media, the containment row including one or more open-bottom chambers, and a substantially water impermeable membrane covering at least the open bottom of the chambers, the water impermeable membrane preventing water in the containment row from exiting directly into the media through the membrane. A detention row is buried in the water permeable media, the detention row including one or more open-bottom chambers, and the detention row configured such that water can exit the bottom of the detention row directly into the media. A pipe system connects the containment row to the detention row, the pipe system configured such that a substantial portion of stormwater that enters the containment row later exits the containment row and travels to the detention row without first passing into the water permeable media.

In another aspect, a stormwater detention system including a containment row buried in water permeable media, the containment row being substantially water impermeable to limit delivery of water from the containment row directly into the water permeable media. A detention row is buried in the water permeable media, the detention row including one or more open-bottom chambers, and the detention row configured such that water can exit the bottom of the detention row directly into the media. A flow system connects the containment row to the detention row, the flow system configured such that a substantial portion of stormwater that enters the containment row later exits the containment row and travels to the detention row without first passing into the water permeable media.

DETAILED DESCRIPTION

Figure 1:
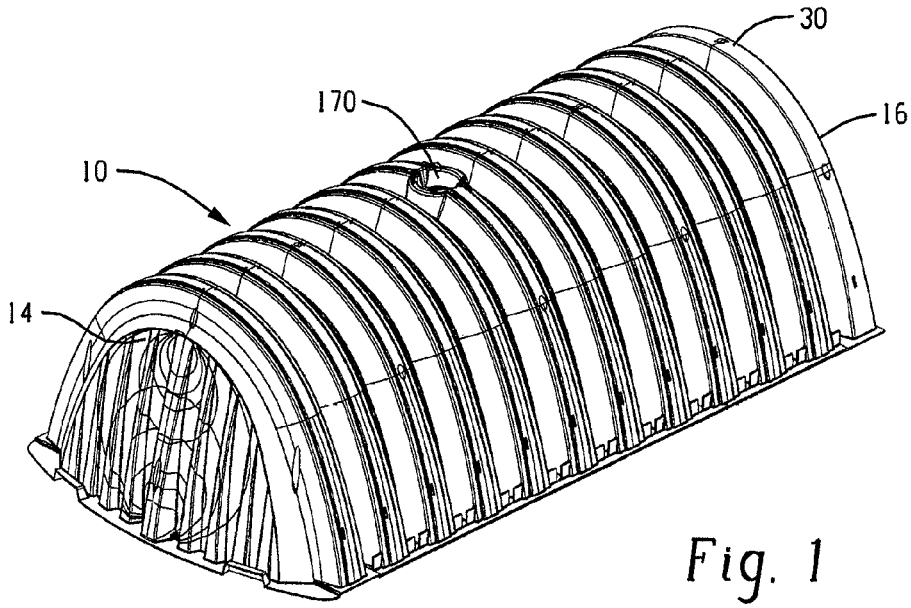
FIGS. 1 and 2 show perspective views of a stormwater detention chamber, respectively with and without an integrated closed end.
Figure 2:
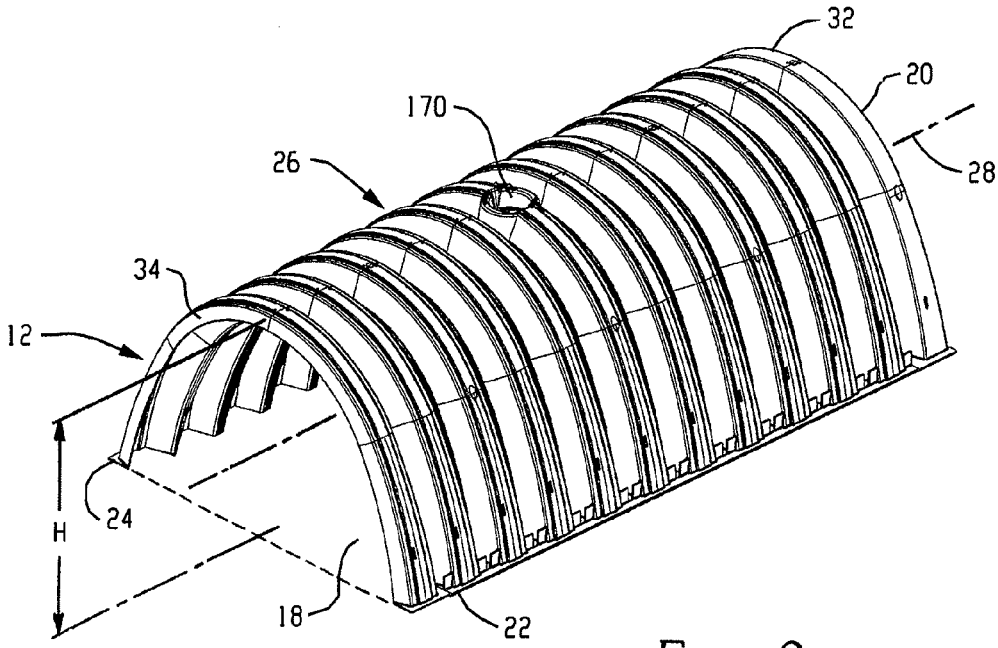
Figure 3:
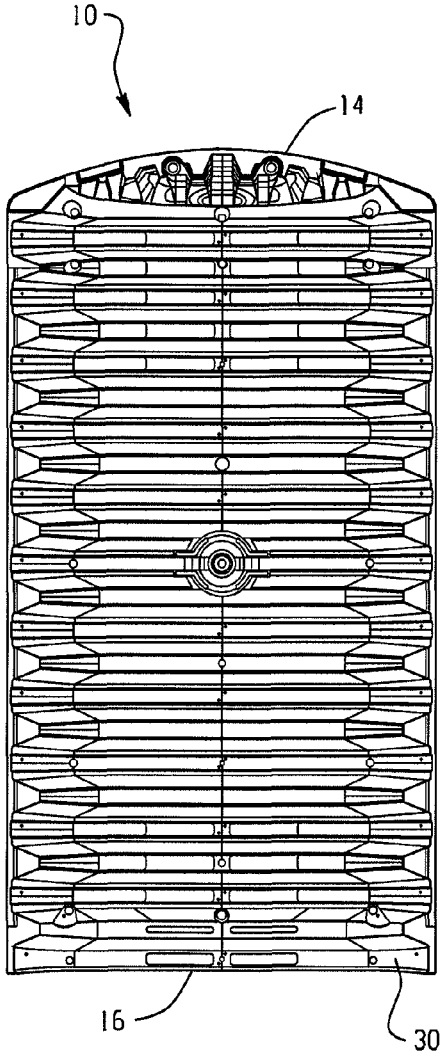
FIGS. 3 and 4 show plan views of a stormwater detention chamber, respectively with and without an integrated closed end.
Figure 4:
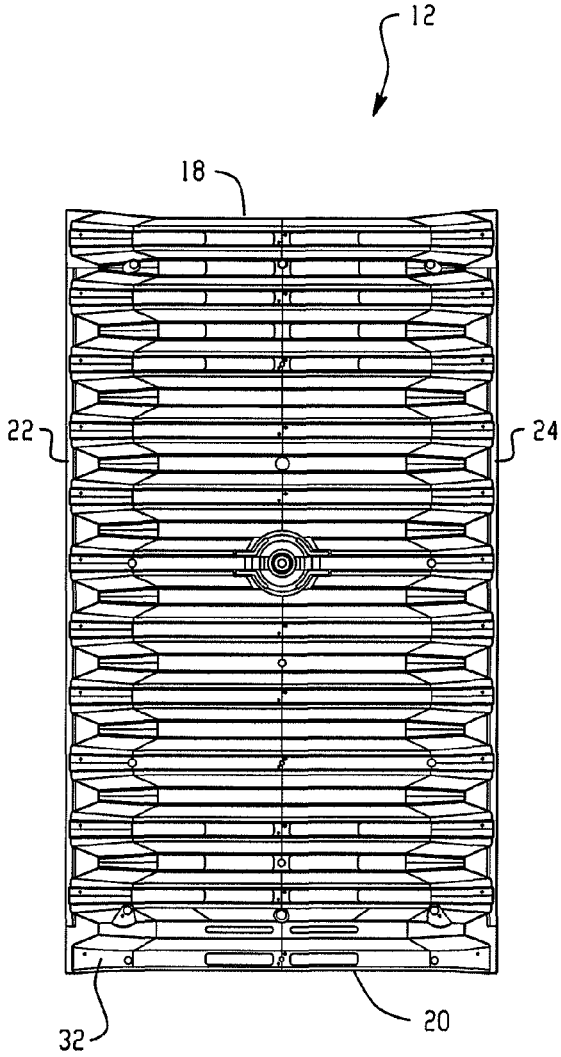

Referring to FIGS. 1-4, perspective views and top plan views of two arch-shaped, corrugated plastic detention chambers 10 and 12 useful in connection with a buried stormwater detention system are shown. Chamber 10 is formed with an integral and unitary end wall 14 at one end and an opposite, open end 16. Chamber 12 is formed with two open ends 18 and 20. Each chamber includes respective spaced apart foot portions 22 and 24 (labeled only in FIG. 2) and a plurality of arch-shaped corrugations 26 distributed along the length of the chamber and running substantially perpendicular to the lengthwise axis 28. End corrugations 30, 32 are of a smaller size to allow overlap by, for example, the opposite end corrugation 34 of an adjacent chamber when a system of chambers is linked together. End corrugation 34 may also be different than the corrugations 26 extending between the ends.

Figure 5:
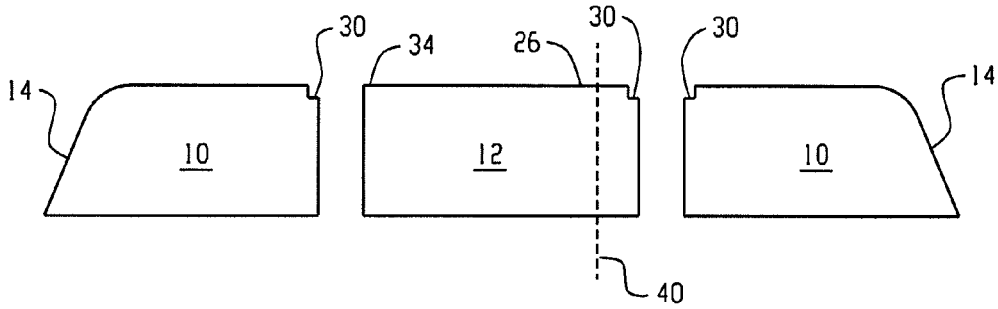
FIGS. 5 and 6 are side elevation schematics illustrating two processes for creating rows with multiple chambers.
Figure 6:
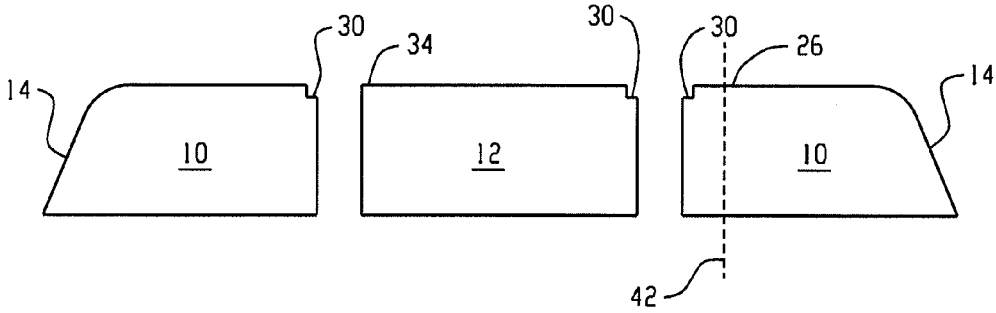

Referring to the schematics of FIGS. 5 and 6, different installation options are described. In both cases, a given row of chambers are connected together end to end to form a continuous, elongated chamber row. The row is formed by respective unitary end wall chambers 10 at the ends, but facing opposite directions, with any number of open-ended chambers 12 positioned therebetween. However, a row might also be formed by just two unitary end wall chambers without any intervening open-ended chambers. Moving from left to right, the smaller end corrugation 30 of the left end chamber is overlapped by an end corrugation 34 of the following chamber 12. The small end corrugation of each intermediate chamber is overlapped by the end corrugation of the next following chamber 12 until the right end chamber 10 is reached. In the case of FIG. 5, the chamber 12 adjacent to the right end chamber 10 may be cut at a desired location 40 so that the end corrugation 30 of the right end chamber can be fitted under one of the intermediate corrugations 26 of the adjacent chamber 12. In the case of FIG. 6, the right end chamber 10 can be cut at a desired location 42 so that the end corrugation 30 of the rightmost chamber 12 can be fitted under an intermediate corrugation 26 of the right end chamber 10. In either manner, a continuous row of overlapping chambers of almost any desired length may be formed.

Other suitable stormwater detention chambers may be used.

The stormwater detention system includes multiple chamber rows buried in water permeable media such as crushed stone. The chamber rows receive stormwater through a pipe system interconnecting the rows, as described below.

Figure 7:
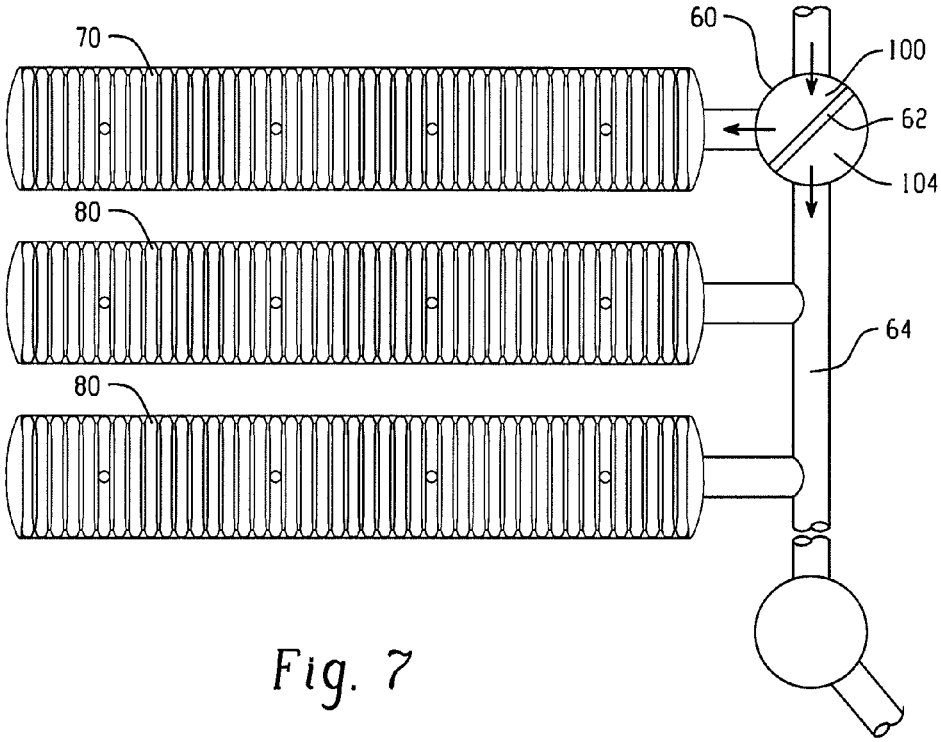
FIG. 7 shows a plan view of one embodiment of a stormwater detention chamber system.
Figure 8:
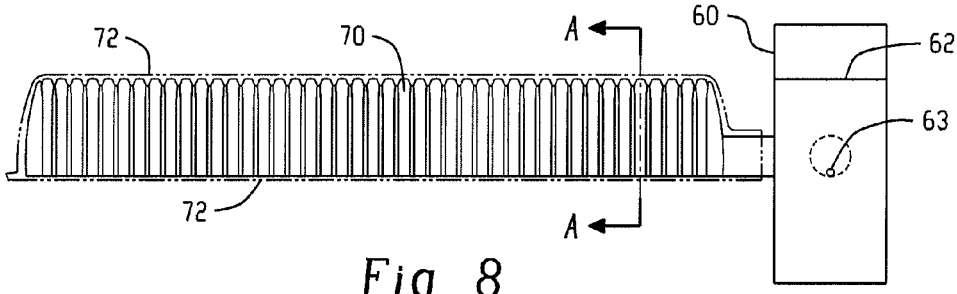
FIG. 8 shows an elevation view of the system shown in FIG. 7.
Figure 8A:
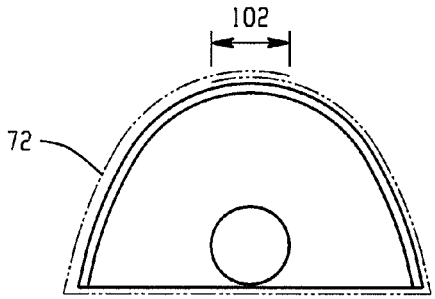
FIG. 8A shows a cross section of a chamber along A-A from FIG. 8.

Referring to FIGS. 7, 8, and 8A, water entering the detention system is delivered to a diversion structure or manhole 60 having an internal overflow weir 62. The upstream side 100 of the diversion manhole 60 is connected to deliver water to a row of chambers 70 that is wrapped in a water impermeable membrane 72. An exemplary water impermeable membrane that could be utilized is a 20 mil polyethylene sheeting. However, other impermeable membranes could be used. The water impermeable membrane 72 extends across the open bottoms of the chambers and upward along the sides of the chambers with an overlap 102 along an upper portion of the chambers, to inhibit flow of water from the containment row 70 into the water permeable media that surrounds the containment row 70 when buried. Backfill around and over the chambers may aid in holding the wrapped water impermeable membrane 72 in place. Fasteners could also be used to connect the overlap regions together. In other embodiments, the water impermeable membrane need not be wrapped entirely around the containment row 70. For example, the water impermeable membrane could simply extend across the open bottom of the chamber, with the foot portions of the chambers seated on the membrane to substantially seal flow thereby.

Incoming water is diverted by the manhole weir 62 into the containment row 70 until the containment row 70 fills sufficiently to cause water to overflow the weir 62 to a downstream side 104 of the diversion manhole 60, which is connected to a pipe manifold 64 that delivers the water to one or more additional chamber rows 80. The additional chamber rows 80 are not wrapped, and are also buried in the water permeable media.

Due to the impermeable membrane 72 surrounding the containment row 70, water cannot exit the containment row directly into the water permeable media. Instead, the water is delivered directly (e.g., by traveling internal of a pipe) into one or more of the additional chamber rows 80 without first passing into the water permeable media. The water may travel from the containment row 70 into the additional rows 80 through several different arrangements of the detention system, as described in the embodiments below.

Figure 9:
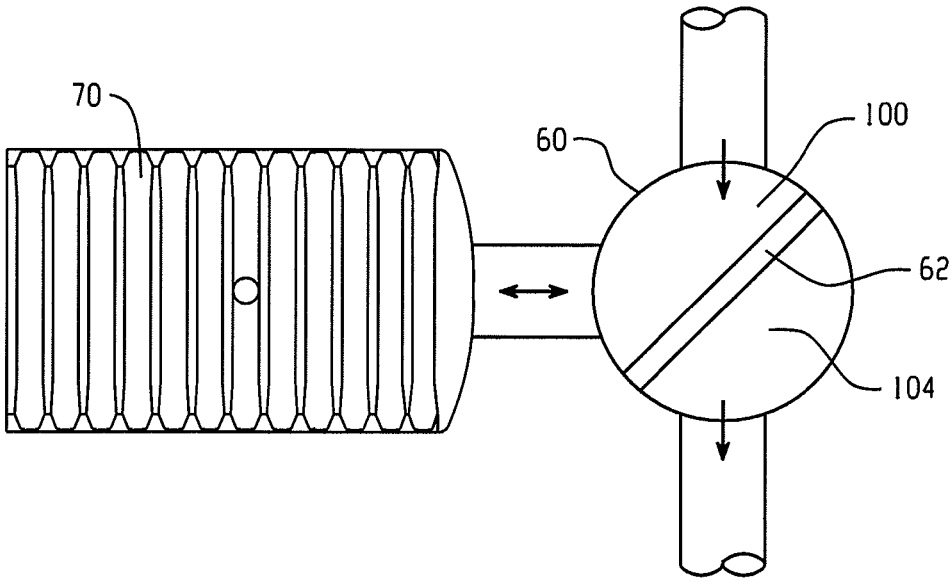
FIG. 9 shows a plan view of a detention system including a drain down orifice.
Figure 10:
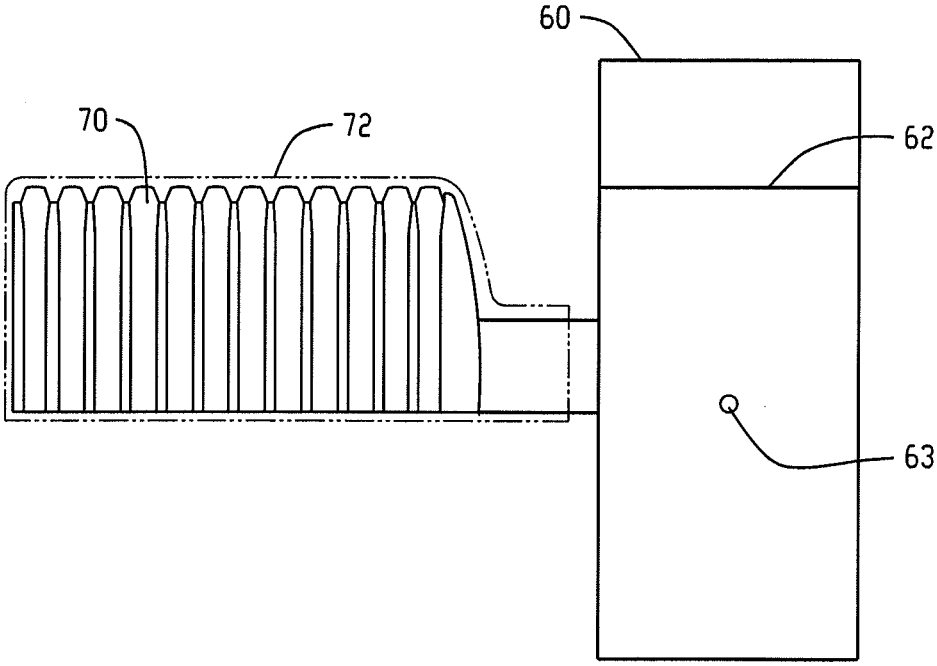
FIG. 10 shows an elevation view of the system of FIG. 9.

In one embodiment, shown in FIGS. 8-10, the weir 62 includes a small drain down orifice 63 at an elevation corresponding to the bottom of the containment row 70 so that water from the containment row 70 can pass back into the diversion manhole 60, through the weir drain down orifice 63 and then into the pipe manifold 64 where the water is delivered to the additional chamber rows 80. As an alternative to the drain down orifice, a vortex valve could be positioned in the weir.

Figure 11:
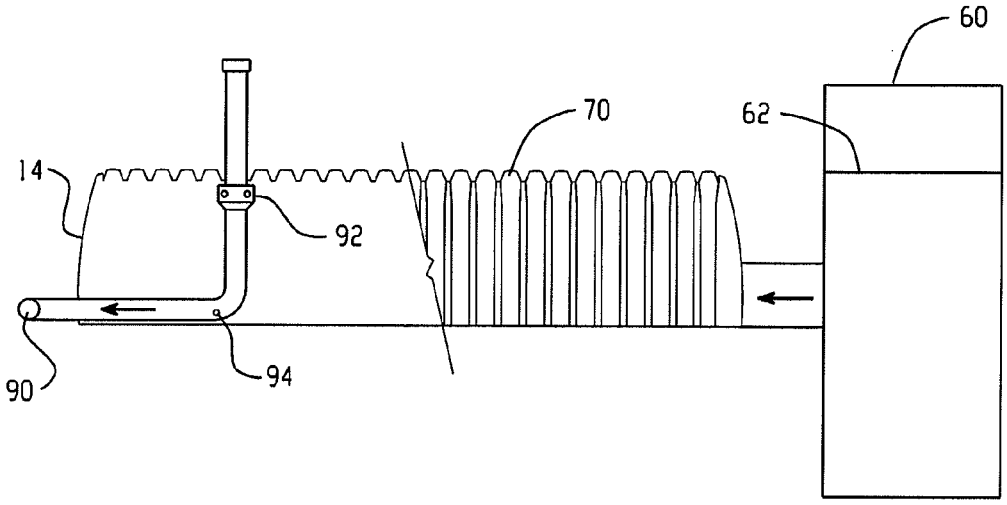
FIG. 11 shows an elevation view of a detention system including an outlet riser pipe.
Figure 13:
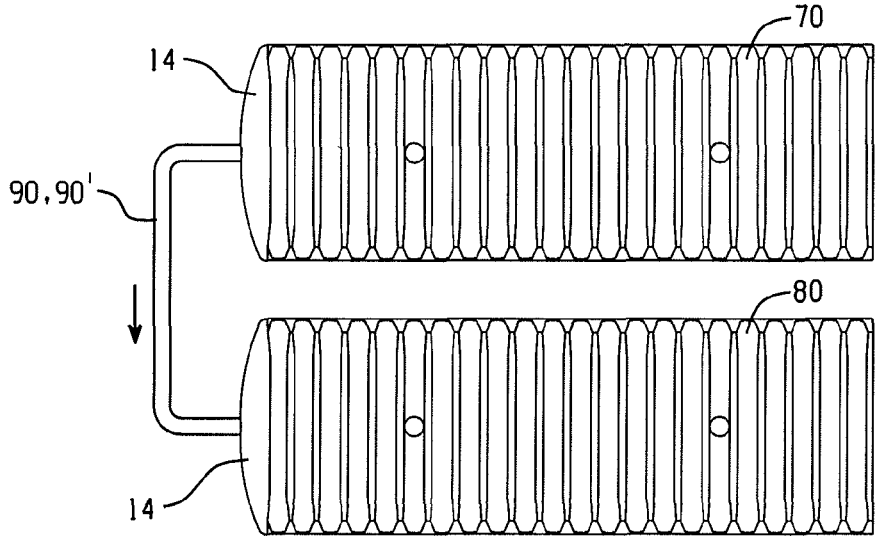
FIG. 13 shows a plan view of the detention system of FIG. 12.

In another embodiment, shown in FIG. 11, the weir 62 is solid, lacking any drain down orifice or other passage. Instead, a pipe transfer system is provided in the containment row 70 and includes an upwardly extending outlet riser pipe 92 in the containment row, which riser pipe 92 connects with an outlet pipe 90 that exits an end wall 14 of the containment row 70 and travels laterally to one or more of the additional chamber rows 80 (e.g., per FIG. 13). The water reaching an upper elevation in the containment row 70 enters the riser pipe 92 and travels along the outlet pipe 90 where the water is delivered to the additional chamber rows 80. A drain down orifice 94 is also provided in the pipe transfer system to allow all water to eventually drain out of the containment row 70.

Figure 12:
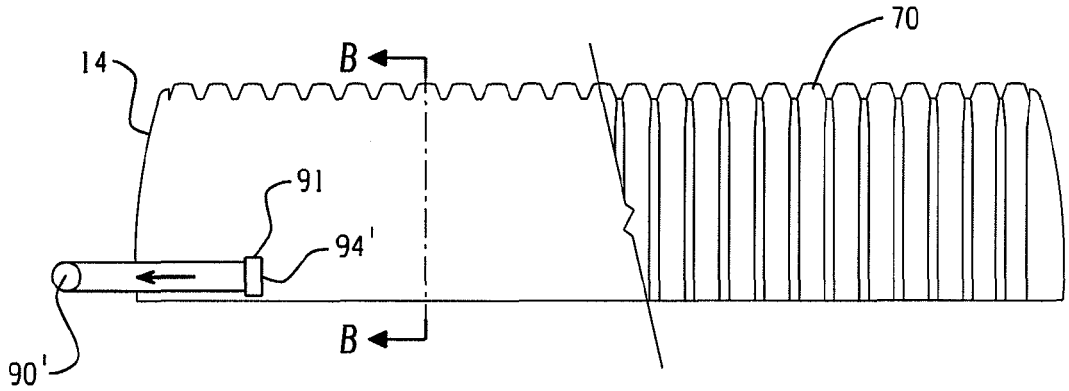
FIG. 12 shows an elevation view of a detention system including an outlet pipe with drain down orifice.
Figure 12B:
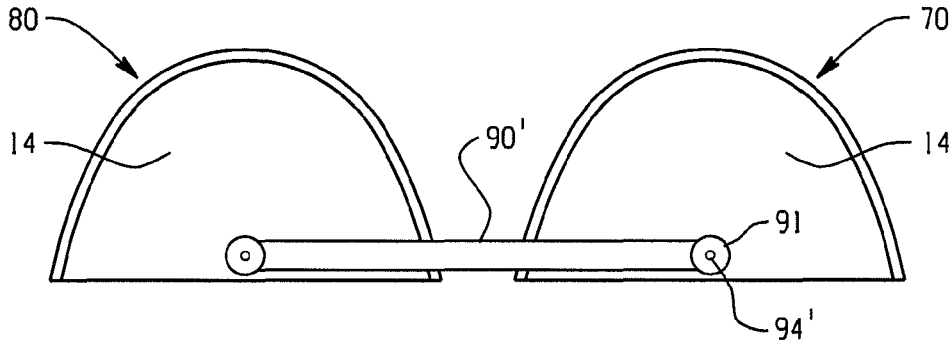
FIG. 12B shows a cross section of the system along B-B from FIG. 12.

FIGS. 12 and 12B show another embodiment where the containment row 70 includes a pipe transfer system. In this embodiment, the pipe transfer system lacks an upwardly extending outlet riser pipe, but includes an outlet pipe 90' that exits the end wall 14 and travels laterally to another chamber row (e.g., per FIG. 13). The inlet end of the outlet pipe 90' includes a pipe cap 91 with a drain down orifice 94' so that water can travel from the containment row 70 into the outlet pipe where the water is delivered to the additional chamber rows 80.

Figure 14:
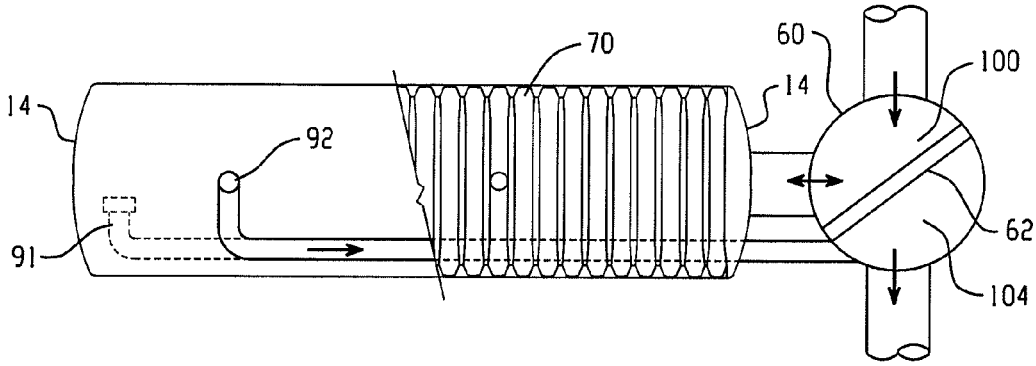
FIG. 14 shows a plan view of a detention system illustrating two different positions for an outlet pipe.
Figure 15:
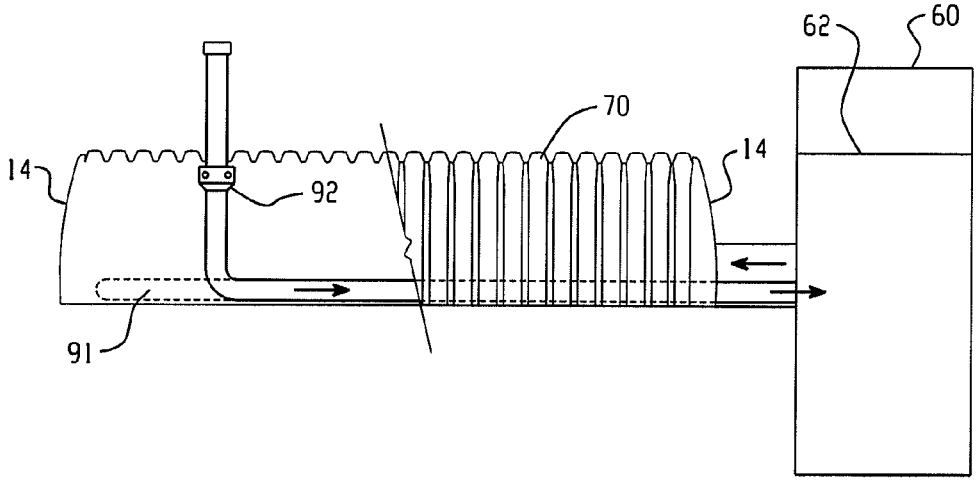
FIG. 15 shows an elevation view of the detention system of FIG. 14.

FIGS. 14 and 15 show embodiments with pipe transfer systems that flow back into the downstream portion 104 of the diversion manhole 60. From there, the water travels the pipe manifold 64 as shown in FIG. 7 in order to arrive at additional rows 80. As shown, the riser pipe may or may not be used.

In any of the above embodiments where a drain down orifice is shown, other devices may be used in place of the drain down orifice. For example, a flow regulation mechanism such as a vortex valve may be used.

Figure 16:
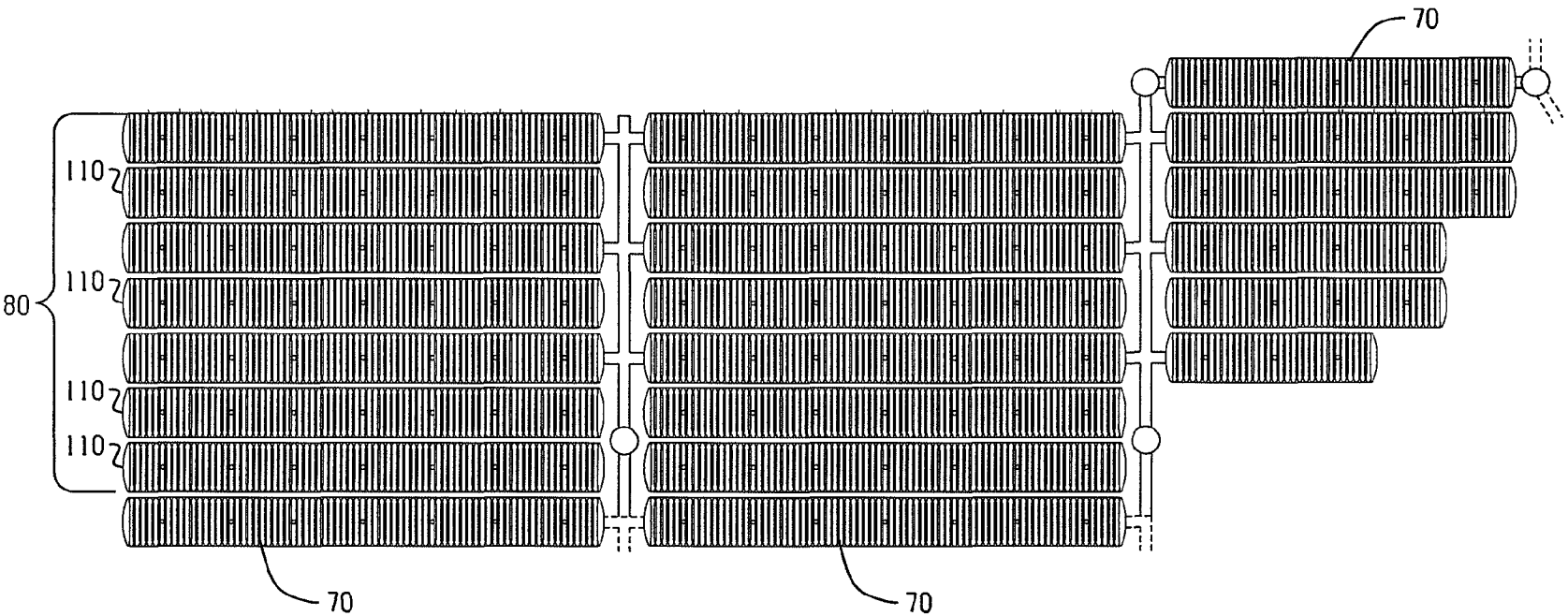
FIG. 16 shows a plan view of an exemplary chamber-type detention system with multiple containment rows.

Referring to FIG. 16, the water detention system may also include individual chambers or chamber rows that are not connected by piping to the rest of the system (e.g., per rows 110). These chambers or rows are also buried within the water permeable media, do not include any sort of impermeable membrane, and act as independent stormwater detention chambers by holding water that flows to them through the media. A given detention system may also include multiple containment rows, as illustrated in FIG. 16. For example, the upstream side of a single diversion manhole can feed two distinct containment rows on opposite sides of the diversion manhole. Moreover, some detention systems may include multiple diversion manholes that receive stormwater runoff and deliver it into distinct containment rows of the detention system.

Debris that collects within the containment row(s) can be cleaned using a suitable spray and/or vacuum system that can be inserted into the containment rows through the top of the diversion manhole. Such cleanout operations could also be performed by accessing the containment row(s) through one or more of the access ports 170 (see FIG. 1) located atop the chambers that make up the row.

In some system implementations it may be desirable to provide some filtering of the water in the containment row before that water is delivered to the detention row or rows. Such filtering could be achieved in a variety of ways.

Figure 17:
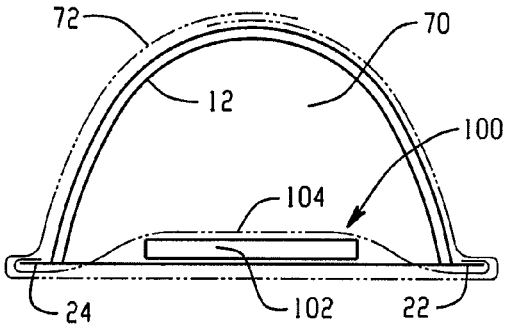
FIG. 17 shows a cross-section of a containment row embodiment with a filtering floor drain structure.
Figure 18:
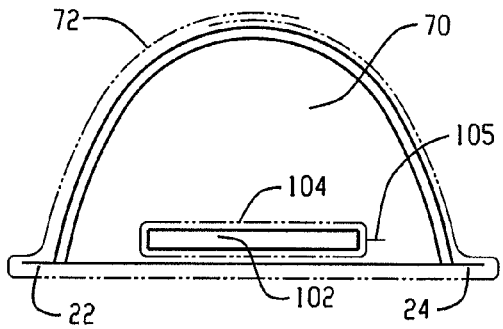
FIG. 18 shows a cross-section of a containment row with an alternative floor drain structure.

Referring to cross-section of FIG. 17, in one embodiment, the containment row 70 wrapped in impermeable membrane 72, includes a floor drain structure 100. In one embodiment, the floor drain structure includes a generally planar strip or sheet drain 102 covered by a permeable geotextile material 104 that is sized for target sediment particle diameter removal (e.g., the geotextile will allow sediment particles only smaller than the target size into the strip drain). The foot portions 22 and 24 of the chamber pin down the edges of the geotextile 104 and prevents flow from finding a path around the geotextile and into the strip drain 102 so that substantially all flow must migrate through the geotextile to get to the strip drain. In an alternative embodiment, as shown in FIG. 18, the geotextile 104 may be wrapped around the strip drain 102 entirely, with a mated edge seal 105, to achieve a similar purpose (e.g., the geotextile forms a sock or tube in which the strip drain 102 sits). The strip drain may generally be any structure that provides a desired volume for the drain down path through the geotextile. For example, the planar strip drain may be any perforated structure (e.g., flattened perforated pipe) or other structure that keeps the upper and lower portions of the sock structure separated to create a drainage path for water that passes through the sock. One example is the AKWADRAIN product available from American Wick Drain of Monroe, N.C. The sock structure could alternatively be formed of other suitable filtering materials, such as any filter fabric or even spongelike filter members. In some applications it may be possible to utilize a perforated strip drain structure 102 without the filter fabric by utilizing perforations that are sized to achieve desired filtering.

Figure 19:
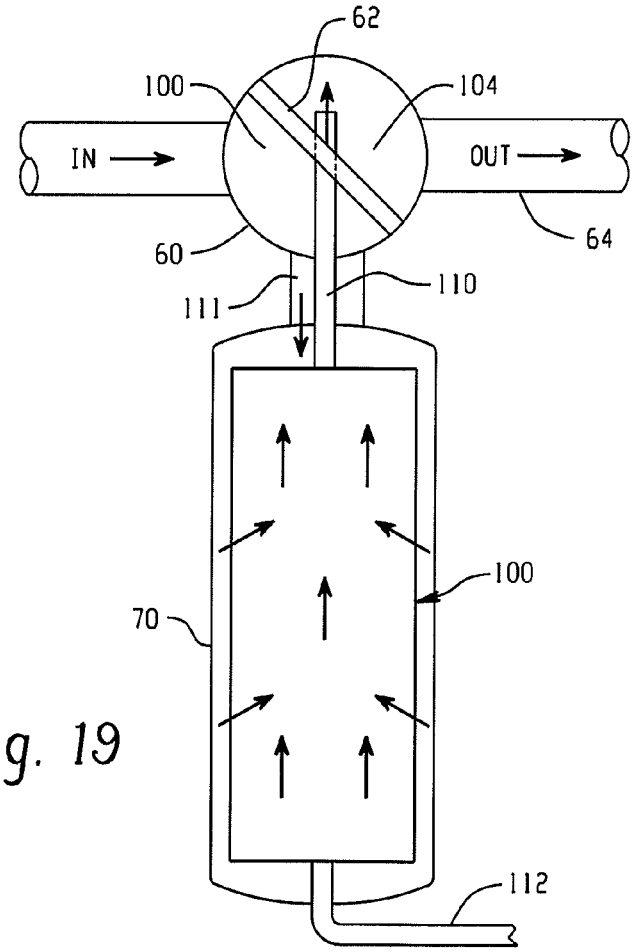
FIG. 19 shows a partial top plan view of a system according to either FIG. 17 or FIG. 18.
Figure 25:
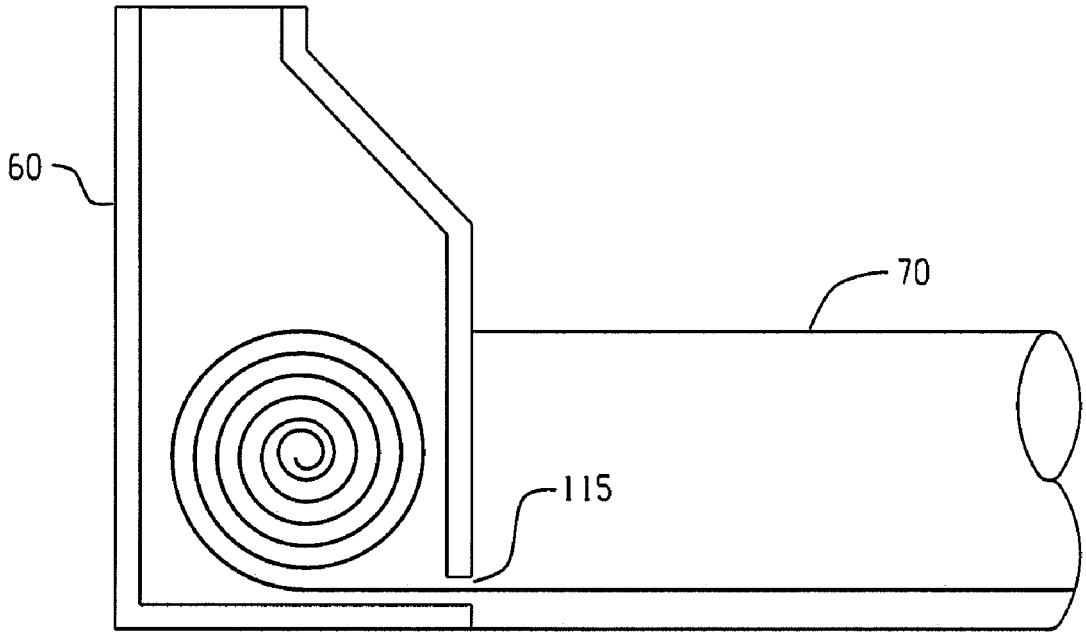
FIG. 25 shows a side elevation view of a rolled floor drain structure.
Figure 26:
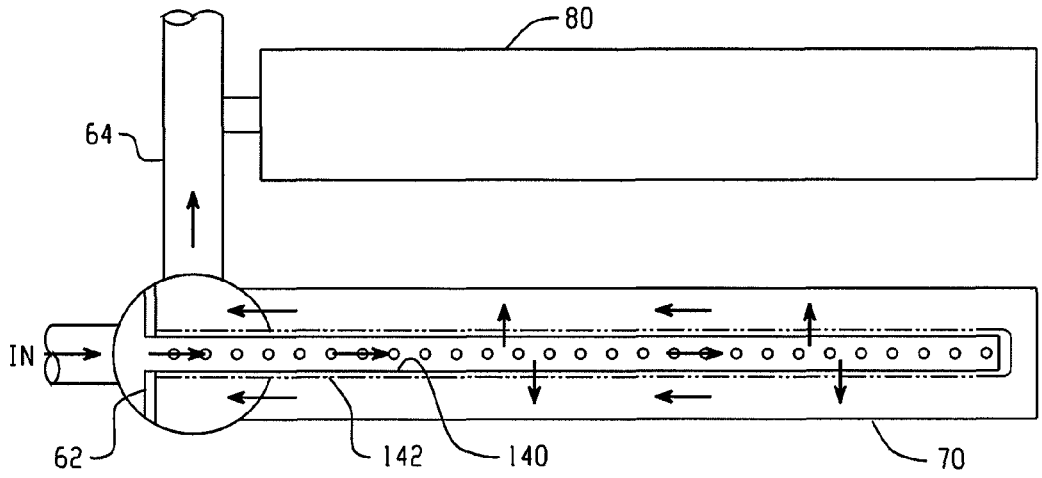
FIG. 26 shows a partial top plan view of an alternative embodiment in which water is filtered prior to entering a main volume of the containment row.

In either of the above implementations, the floor drain structure may be connected to deliver water that enters the floor drain structure to the detention row or rows of a system by suitable piping. For example, referring to FIG. 19, an invert located drain down pipe structure 110, which may be positioned within the main delivery pipe 111 from the manhole 60 to the containment row 70, may be connected at the end of the floor drain structure for collecting the filtered water in the floor drain structure and delivering it through the diversion manhole weir 62 to the downstream side of the weir where the filtered water can then travel along the pipe manifold 64 to the detention rows. Alternatively, or in addition, an invert located drain down pipe structure 112 at the far end of the containment row 70 may collect the filtered water and deliver it directly to a detention row. Multiple drain down pipes could be provided in either case. Additionally, in either case, a gasket or bracket may cover the end of the strip drain structure 102 and have adapters for one or more flex hoses to be used as the drain down pipe structure. In one implementation, per FIG. 25, the floor drain structure may be formed sufficiently flexible to permit the structure to be coiled or rolled for ease of installation, as by pulling the structure through a slot that feeds from the manhole 60 to the containment row 70.

Figure 20:
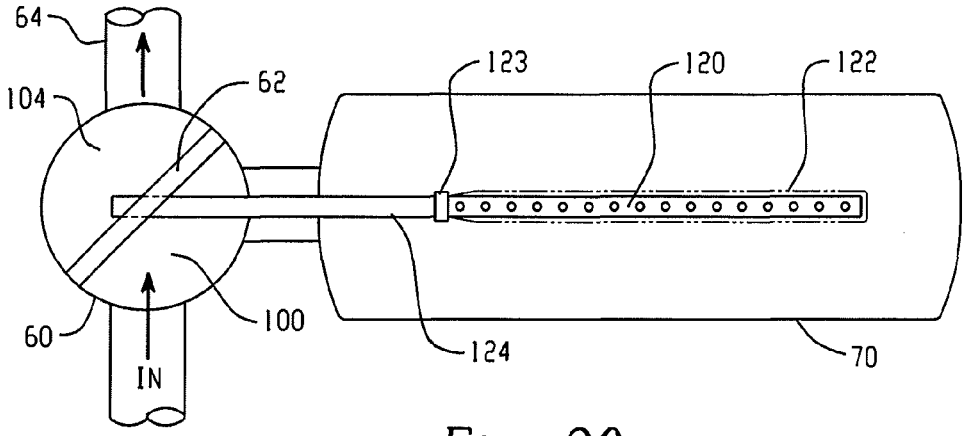
FIG. 20 shows a partial top plan view of a system with an alternative floor drain structure.
Figure 21:
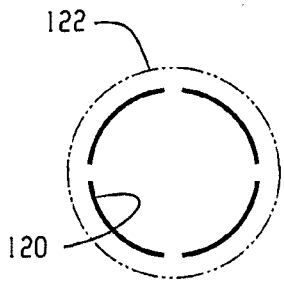
FIGS. 21 and 22 are cross-sections showing alternatives of the floor drain structure according to FIG. 20.
Figure 22:
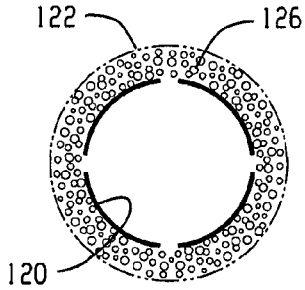

In another embodiment, the floor drain structure could be formed by an invert located perforated pipe 120 within a geotextile sock 122 as shown in FIG. 20. The perforated pipe 120 connects (e.g, by a coupler 123) with an invert located solid wall drain down pipe 124 that extends back through the diversion manhole weir 62 in a manner similar to that described above. Again, the geotextile sock is sized to define the level of filtering, and more than one of these filtering pipe structures could be included in the containment row 70. In one implementation, per FIG. 21, the geotextile sock 122 may be wrapped directly around the perforated pipe 120. In another implementation, per FIG. 22, an annular spacing structure 126 (e.g., foam material) could be placed between the sock and the pipe.

Figure 24:
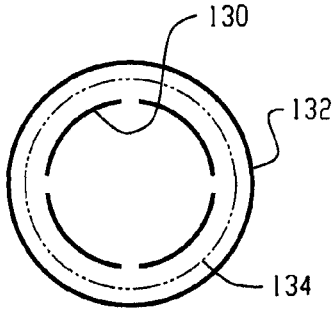
FIG. 24 shows a cross-section of the floor drain structure of FIG. 23.
Figure 23:
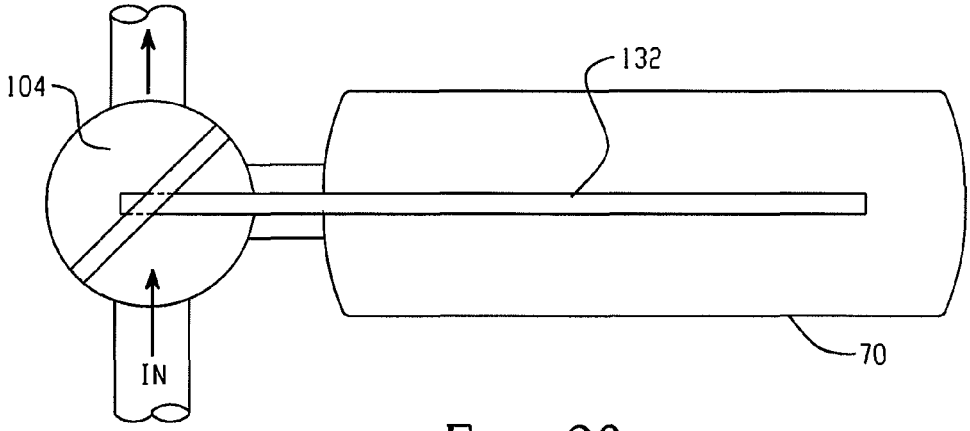
FIG. 23 shows a partial top plan view of a system with another alternative floor drain structure.

In another embodiment, shown in FIGS. 23 and 24, the floor drain structure could be a flexible pipe 130 within a rigid pipe 132. In this arrangement, the flexible pipe (e.g. 3-6 inch diameter perforated corrugated pipe is placed within a filter sock 134. The rigid pipe, (e.g., slightly larger, rigid perforated pipe) extends from the weir into the containment row 70. The flexible structure can be inserted within the rigid pipe from the downstream side of the weir. When the filter sock becomes occluded, the pipe 130 and sock 134 can be retrieved by simply pulling from the downstream side 104 of the weir, and replaced with a new pipe and sock, or the sock removed remove the existing pipe 130 and replaced with a new sock, prior to reinsertion in the rigid pipe 132.

Figure 27:
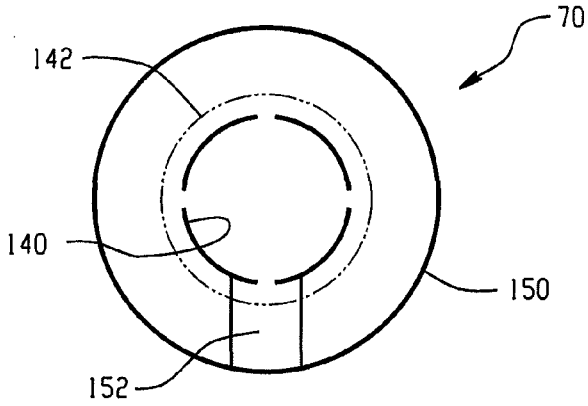
FIG. 27 shows a cross-section of one implementation of the embodiment of FIG. 27.

In a further embodiment, the containment row 70 may fed from the diversion manhole 60 by a perforated pipe 140 that extends along the row 70 and is covered by a filter material 142 (e.g., a geotextile or other filter sock). Incoming water flows along the pipe 140 and must travel through the filter material 142 before traveling back along the containment row 70 to the downstream side of the manhole weir 62 for delivery to the pipe manifold 64 and the detention rows 80. In one implementation, per FIG. 27, the containment row 70 may be formed of a pipe 150 (e.g., corrugated metal pipe) instead of a row of chambers, and the delivery pipe 140 may be supported in an elevated manner within the containment row pipe 150 on a series of spaced apart pedestals 152.

It is to be clearly understood that the above description is intended by way of illustration and example only and is not intended to be taken by way of limitation, and that changes and modifications are possible, including both narrower and broader variations of the exemplary claims appended hereto. Accordingly, other embodiments are contemplated and modifications and changes could be made without departing from the scope of this application.

The invention claimed is:

1. A stormwater detention system, comprising:

a containment row buried in water permeable media, the containment row including:

one or more open-bottom chambers, and a substantially water impermeable membrane covering at least the open bottom of the chambers, the water impermeable membrane preventing water in the containment row from exiting directly into the media through the membrane;

a detention row buried in the water permeable media, the detention row including one or more open-bottom chambers, the detention row configured such that water can exit the bottom of the detention row directly into the media;

a pipe system connecting the containment row to the detention row, the pipe system configured such that a substantial portion of water that enters the containment row later exits the containment row and travels to the detention row without first passing into the water permeable media;

wherein the pipe system includes a diversion structure with an overflow weir, such that water up to a certain level within the diversion structure is diverted to the containment row, but water overflowing the weir bypasses the containment row to a downstream side of the diversion structure, and wherein a pipe manifold connects the downstream side of the diversion structure to the detention row;

wherein the weir includes a drain down path, such that water that enters the containment chamber eventually passes back into the diversion structure, and passes out the drain down path to the pipe manifold for delivery to the detention row.

2. The stormwater detention system of claim 1, wherein the open-bottom chambers included in the containment and detention rows are substantially arch-shaped in cross section and corrugated along their length.

3. A stormwater detention system, comprising:

a containment row buried in water permeable media, the containment row including:

one or more open-bottom chambers, and a substantially water impermeable membrane covering at least the open bottom of the chambers, the water impermeable membrane preventing water in the containment row from exiting directly into the media through the membrane;

a detention row buried in the water permeable media, the detention row including one or more open-bottom chambers, the detention row configured such that water can exit the bottom of the detention row directly into the media;

a pipe system connecting the containment row to the detention row, the pipe system configured such that a substantial portion of water that enters the containment row later exits the containment row and travels to the detention row without first passing into the water permeable media;

wherein the water impermeable membrane is wrapped about the entirety of the containment row with overlap proximate the top portion of the containment row.

4. The stormwater detention system of claim 3, wherein the pipe system includes an outlet pipe assembly that connects the containment row directly with the detention row, the outlet pipe assembly having an inlet within the containment row and an outlet within the detention row.

5. The stormwater detention system of claim 4, wherein the inlet of the outlet pipe assembly includes a flow regulator.

6. The stormwater detention system of claim 4, wherein the outlet pipe assembly includes a riser pipe, the inlet near the top of the riser pipe, and a drain down path along a lower portion of the outlet pipe assembly, such that water entering the containment row exits through either the inlet of the riser pipe or the drain down path.

7. The stormwater detention system of claim 3, wherein the pipe system includes an outlet pipe assembly that connects the containment row with the downstream side of the diversion structure, the outlet pipe assembly including an inlet opening within the containment row and an outlet within the downstream side of the diversion structure.

8. The stormwater detention system of claim 7, wherein the outlet pipe assembly includes a flow regulator.

9. The stormwater detention system of claim 7, wherein the outlet pipe assembly includes a riser pipe, the inlet near the top of the riser pipe, and a drain down path along a lower portion of the outlet pipe assembly, such that water entering the containment row exits through either the inlet of the riser pipe or the drain down path.

10. The stormwater detention system of claim 3 wherein the pipe system includes an associated filter structure for filtering water that exits the containment row and travels to the detention row without first passing into the water permeable media.

11. The stormwater detention system of claim 10 wherein the filter structure comprises a filter material disposed around at least a portion of the pipe system that is located within the containment row, the portion comprising a perforated pipe structure.

12. The stormwater detention system of claim 11 wherein the portion comprises a flexible perforated pipe surrounded by the filter material, and is inserted within a rigid perforated pipe within the containment row.

13. A stormwater detention system, comprising:

a containment row buried in water permeable media, the containment row including:

one or more open-bottom chambers, and a substantially water impermeable membrane covering at least the open bottom of the chambers, the water impermeable membrane preventing water in the containment row from exiting directly into the media through the membrane;

a detention row buried in the water permeable media, the detention row including one or more open-bottom chambers, the detention row configured such that water can exit the bottom of the detention row directly into the media;

a pipe system connecting the containment row to the detention row, the pipe system configured such that a substantial portion of stormwater that enters the containment row later exits the containment row and travels to the detention row without first passing into the water permeable media;

wherein the pipe system includes an associated filter structure for filtering water that exits the containment row and travels to the detention row without first passing into the water permeable media;

wherein the filter structure comprises a filter material within the containment row and located to feed water from the containment row to the pipe system.

14. The stormwater detention system of claim 13 wherein the filter material is wrapped about a generally flat strip drain structure that has one end connected to the pipe system.

15. A stormwater detention system, comprising:

a containment row buried in water permeable media, the containment row being substantially water impermeable to limit delivery of water from the containment row directly into the water permeable media;

a detention row buried in the water permeable media, the detention row including one or more open-bottom chambers, the detention row configured such that water can exit the bottom of the detention row directly into the media;

a flow system connecting the containment row to the detention row, the flow system configured such that a substantial portion of water that enters the containment row later exits the containment row and travels to the detention row without first passing into the water permeable media;

wherein the flow system includes a diversion structure with an overflow weir, such that water up to a certain level within the diversion structure is diverted to the containment row, but water overflowing the weir bypasses the containment row to a downstream side of the diversion structure, and wherein a pipe manifold connects the downstream side of the diversion structure to the detention row, and a flow path back from the containment row to the diversion structure such that the water that enters the containment chamber eventually passes back into the diversion structure and then to the pipe manifold for delivery to the detention row.

16. The stormwater detention system of claim 15 wherein the containment row is fed by a pipe associated with the diversion structure for delivering water from an upstream side of the diversion structure into the pipe, the pipe extends within and along the containment row and includes an associated filter material, water travels through the filter material in order to enter a main volume of the containment row.

17. The stormwater detention system of claim 16 wherein the main volume of the containment row is connected to permit flow of filtered water to a downstream side of the diversion structure for subsequent delivery to the detention row.

18. The stormwater detention system of claim 17 wherein the containment row is formed by a non-perforated pipe structure.

19. The stormwater detention system of claim 15 wherein water traveling along the flow path back from the containment row to the diversion structure passes through the weir before entering the pipe manifold.

* * * * *